US007832777B2

(12) United States Patent
Banks et al.

(10) Patent No.: US 7,832,777 B2
(45) Date of Patent: Nov. 16, 2010

(54) DOOR LOCK ASSEMBLY

(75) Inventors: Russell A. Banks, Indianapolis, IN (US); Bradley W. Trent, Noblesville, IN (US)

(73) Assignee: Von Duprin, Inc., Indianapolis, IN (US)

( * ) Notice: Subject to any disclaimer, the term of this patent is extended or adjusted under 35 U.S.C. 154(b) by 692 days.

(21) Appl. No.: 11/398,574

(22) Filed: Apr. 5, 2006

(65) Prior Publication Data

US 2007/0246947 A1 Oct. 25, 2007

(51) Int. Cl.
*E05B 65/10* (2006.01)
*E05B 65/00* (2006.01)

(52) U.S. Cl. ..... 292/92; 292/93; 292/94; 70/92

(58) Field of Classification Search ..... 292/92–94; 70/92

See application file for complete search history.

(56) References Cited

U.S. PATENT DOCUMENTS 1,244,443 A * 10/1917 Hurd ..... 292/92
1,535,210 A 4/1925 Dyer
2,513,069 A * 6/1950 Weissinger ..... 292/92
3,614,145 A 10/1971 Zawadzki
3,652,113 A * 3/1972 Odend'hal et al. ..... 292/216
3,788,687 A * 1/1974 Zawadzki ..... 292/92
3,877,262 A * 4/1975 Williams ..... 70/92
3,970,339 A 7/1976 Haselton et al.
4,135,746 A * 1/1979 Sterling ..... 292/92
4,161,804 A 7/1979 D'Hooge
4,314,722 A 2/1982 Logan, Jr.
4,324,425 A 4/1982 Logan
4,328,985 A 5/1982 Logan
4,351,552 A 9/1982 VanDerLinden
4,354,699 A 10/1982 Logan
4,466,643 A 8/1984 Godec et al.
4,470,625 A 9/1984 Walsh et al.
4,545,606 A * 10/1985 Vodra ..... 292/92
4,656,690 A 4/1987 Katagiri et al.
4,680,891 A 7/1987 Perkins
4,709,950 A 12/1987 Zortman
4,715,146 A 12/1987 Atsumi et al.
4,741,563 A 5/1988 Cohrs
4,747,629 A 5/1988 Miller
4,785,286 A 11/1988 Martin
4,796,931 A 1/1989 Heid
4,801,163 A 1/1989 Miller
4,839,988 A 6/1989 Betts et al.
4,865,367 A 9/1989 Choi (Continued)

*Primary Examiner*—Carlos Lugo
(74) *Attorney, Agent, or Firm*—Michael Best & Friedrich LLP

(57) ABSTRACT

A lock assembly for use with a door movably coupled to a door frame. The lock assembly includes a housing, a control member, a latchbolt, and a locking member. The control member is movably coupled to the housing from a locked position to an unlocked position to allow the door to move with respect to the door frame. The latchbolt moves with respect to the housing in a first direction and a second direction. The locking member is configured for engagement with the control member to move the locking member with respect to the housing into and out of an engaged position with respect to the latchbolt. The locking member includes a surface that contacts the latchbolt when the locking member is in the engaged position to substantially prevent movement of the latchbolt in the first and second directions.

36 Claims, 8 Drawing Sheets

U.S. PATENT DOCUMENTS 4,875,722 A 10/1989 Miller et al.
4,927,193 A 5/1990 Miller
4,961,330 A 10/1990 Evans
4,968,070 A 11/1990 Choi
4,976,476 A 12/1990 Cross et al.
5,011,199 A 4/1991 Lowe et al.
5,016,927 A 5/1991 Toledo
5,169,185 A 12/1992 Slaybaugh et al.
5,184,852 A 2/1993 O'Brien
5,219,385 A 6/1993 Yeh
5,311,168 A 5/1994 Pease, Jr. et al.
5,322,332 A * 6/1994 Toledo et al. ..... 292/92
5,340,171 A 8/1994 Slaybuagh et al.
5,464,259 A * 11/1995 Cohrs et al. ..... 292/92
5,484,176 A 1/1996 Sallwasser
5,490,697 A * 2/1996 Surko, Jr. ..... 292/92
5,605,362 A 2/1997 Surko, Jr.
5,640,863 A 6/1997 Frolov
5,673,949 A 10/1997 Mader et al.
5,762,385 A 6/1998 Mader et al.
5,904,384 A 5/1999 Mader et al.
5,927,765 A 7/1999 Austin et al.
5,947,534 A 9/1999 Zarzycki, Jr.
6,009,732 A 1/2000 Haeck et al.
6,032,985 A * 3/2000 Cutter ..... 292/92
6,048,000 A 4/2000 Geringer et al.
6,145,897 A 11/2000 Locher
6,386,597 B1 5/2002 Walsh, III
6,409,232 B1 6/2002 Nigro, Jr. et al.
6,565,130 B1 5/2003 Walsh, III
6,623,050 B1 * 9/2003 Peng ..... 292/92
6,641,183 B2 11/2003 Brown
6,769,723 B2 8/2004 Cohrs, Jr. et al.
6,854,773 B2 2/2005 Lin
2007/0246946 A1 * 10/2007 Arlinghaus et al. ..... 292/93

* cited by examiner

DOOR LOCK ASSEMBLY

BACKGROUND

The present invention relates to door lock assemblies, and more specifically to locking mechanisms for door lock assemblies.

Exit doors found in large facilities or public buildings typically include a door lock assembly having a push-bar located on an inside surface of the door. The push bar can be depressed to retract a latchbolt to allow a user to open the door. When the door is closed, the latchbolt is in an extended position to engage a strike. The latchbolt can be locked in the extended position to prevent the door from being opened by using an outside handle. Generally, it is desirable to prevent unauthorized retraction of the latchbolt that can allow unwanted opening of the door. One example of an unauthorized retraction includes retracting the latchbolt by directly contacting the latchbolt (i.e., pushing directly on the latchbolt with one's finger). Therefore, the door lock assembly may include a locking mechanism that prevents such unauthorized retraction of the latchbolt when the door is closed.

SUMMARY

In one embodiment, the invention provides a lock assembly configured for use with a door movably coupled to a door frame having a strike. The door is movable between an open position and a closed position. The lock assembly includes a housing, a control member, a latchbolt, and a locking member. The housing is coupled to the door, and the control member is movably coupled to the housing. The control member is movable from a locked position to an unlocked position to allow for movement of the door with respect to the door frame. The latchbolt is movable with respect to the housing in a first direction when the door moves form the closed position to the open position and a second direction when the door moves from the open position to the closed position, the first direction different than the second direction. The locking member is configured for engagement with the control member to move the locking member with respect to the housing into and out of an engaged position with respect to the latchbolt. The locking member includes a surface configured to contact the latchbolt when the locking member is in the engaged position to substantially prevent movement of the latchbolt in the first direction and in the second direction.

In another embodiment the invention provides a lock assembly configured for use with a door movably coupled to a door frame having a strike. The door is movable between a closed position and an open position. The lock assembly includes a housing, a control member, a latchbolt, a locking member, and an auxiliary latchbolt. The housing is coupled to the door, and the control member is movably coupled to the housing. The control member is movable from a locked position to an unlocked position to allow for rotation of the door with respect to the door frame. The latchbolt is movable with respect to the housing in a first direction and a second direction, the first direction different than the second direction. The locking member is configured for engagement with the control member such that the locking member is movable with respect to the housing into and out of an engaged position to generally prevent rotation of the latchbolt in at least one of the first and second directions. The auxiliary latchbolt is configured to bias the locking member out of the engaged position when the door is in the open position.

In yet another embodiment, the invention provides a lock assembly configured for use with a door rotatably coupled to a door frame having a strike. The lock assembly includes a housing coupled to the door, a control member, a latchbolt, and a locking member. The control member is movably coupled to the housing from a locked position to an unlocked position to allow for rotation of the door with respect to the door frame. The latchbolt is rotatable with respect to the housing about a first axis and a second axis, the first axis different than the second axis. The locking member is configured for engagement with the control member to move the locking member with respect to the housing into and out of an engaged position with respect to the latchbolt. The locking member includes a surface configured to contact the latchbolt when the locking member is in the engaged position to substantially prevent rotation of the latchbolt about the first axis and the second axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The present invention will be described with reference to the accompanying drawing figures wherein like numbers represent like elements throughout. Certain terminology, for example, "above", "below", "right", "left", "clockwise", and "counterclockwise" is used in the following description for relative descriptive clarity only and is not intended to be limiting.

DETAILED DESCRIPTION

Figure 1:
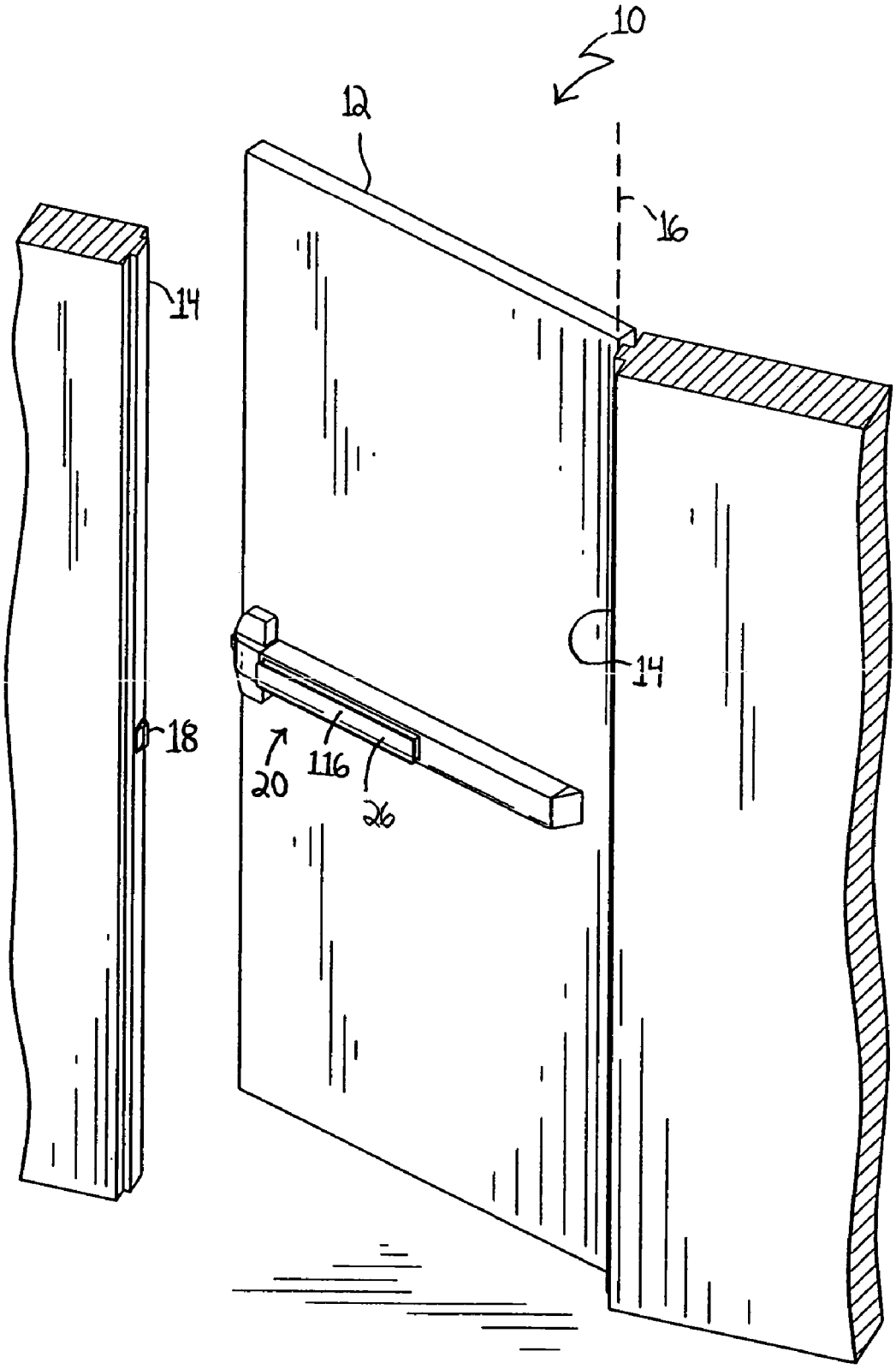
FIG. 1 is a perspective view of a door assembly that includes a lock assembly embodying the present invention.

FIG. 1 illustrates a door assembly 10 that includes a door 12 hingedly coupled to a door frame 14 such that the door 12 can rotate about an axis 16 between a closed position and an open position. While the illustrated door assembly 10 is arranged such that the door 12 rotates or opens outwardly, in other constructions the door assembly can be arranged such that the door rotates or opens inwardly. Furthermore, while the illustrated door 12 is hingedly coupled to the door frame 14, in other constructions the door can be slidably coupled to the door frame.

The door 12 can be made from any suitable material, such as wood, aluminum, composite, etc., or any combination thereof. Furthermore, while FIG. 1 illustrates a single door arrangement, one of skill in the art would realize that in other constructions the door assembly can include double and multiple door arrangements.

A strike 18 is coupled to the door frame 14, and in the illustrated construction the strike 18 is located on a vertical member of the door frame 14, opposite the axis 16. In other constructions, the strike 18 can be located at any suitable location on the door frame 14, such as along upper and lower members of the door fame. Furthermore, while the illustrated door frame 14 includes one strike, in other constructions the door frame can include more than one strike.

Figure 2:
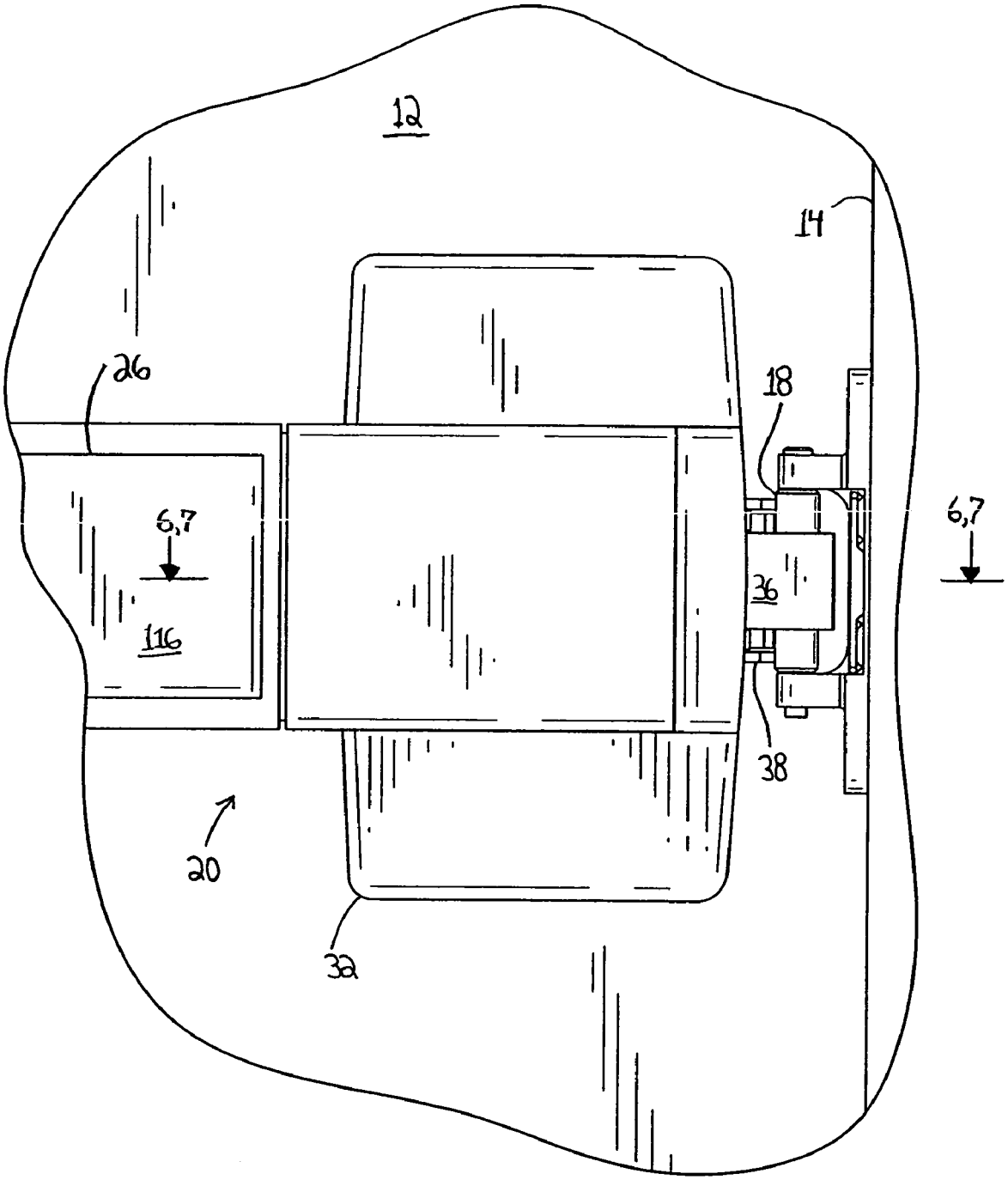
FIG. 2 is a side view of a portion of the door and lock assemblies of FIG. 1 showing the door in a closed position.

Referring to FIGS. 1 and 2, the door assembly 10 further includes a lock assembly 20 coupled to an interior surface of the door 12. While the illustrated lock assembly 20 is located on the interior surface of the door 12, in other constructions the lock assembly can be located on an exterior surface of the door.

Figure 3:
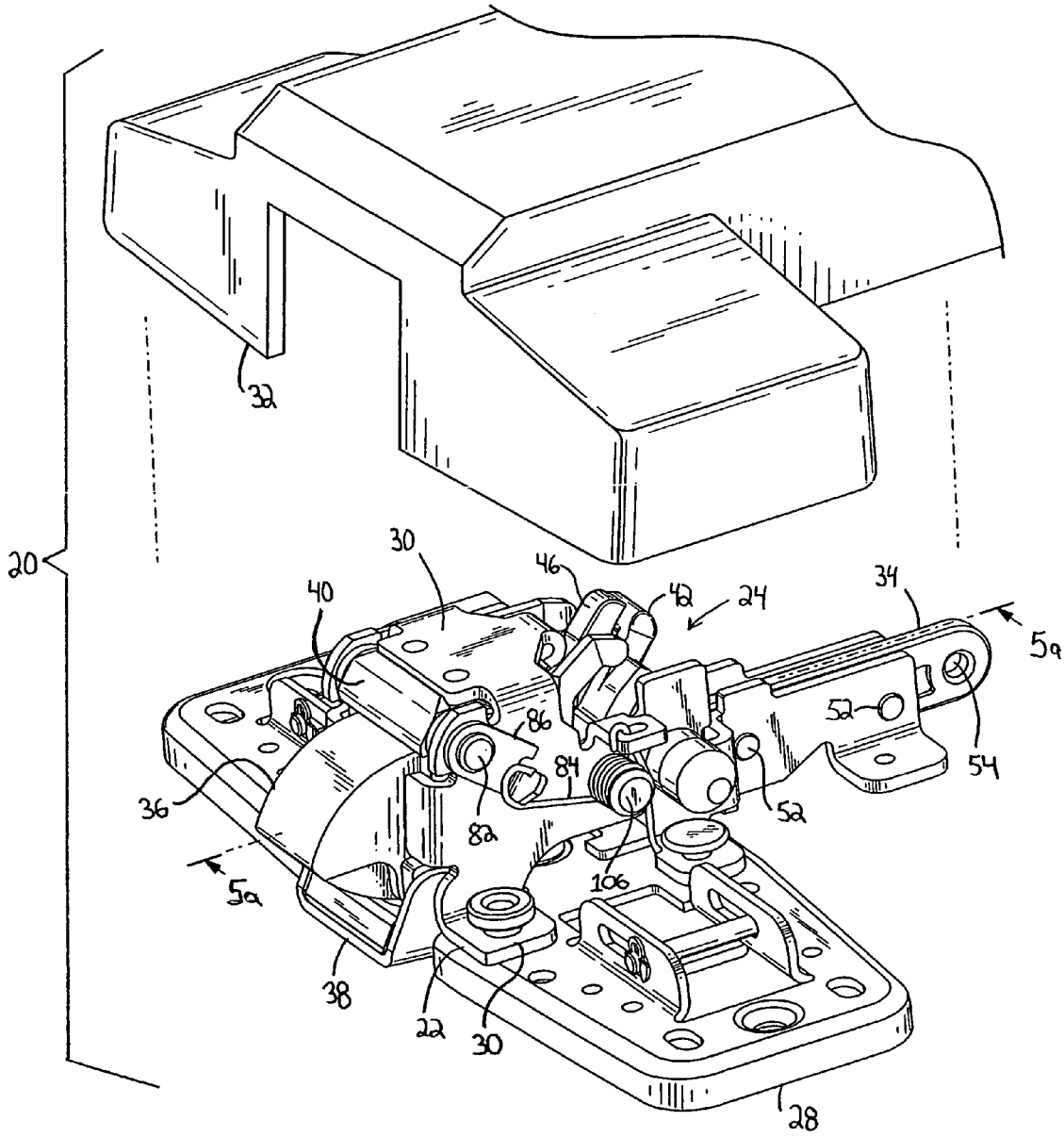
FIG. 3 is a perspective view of a portion of the lock assembly of FIG. 1 with a cover exploded.
Figure 4:
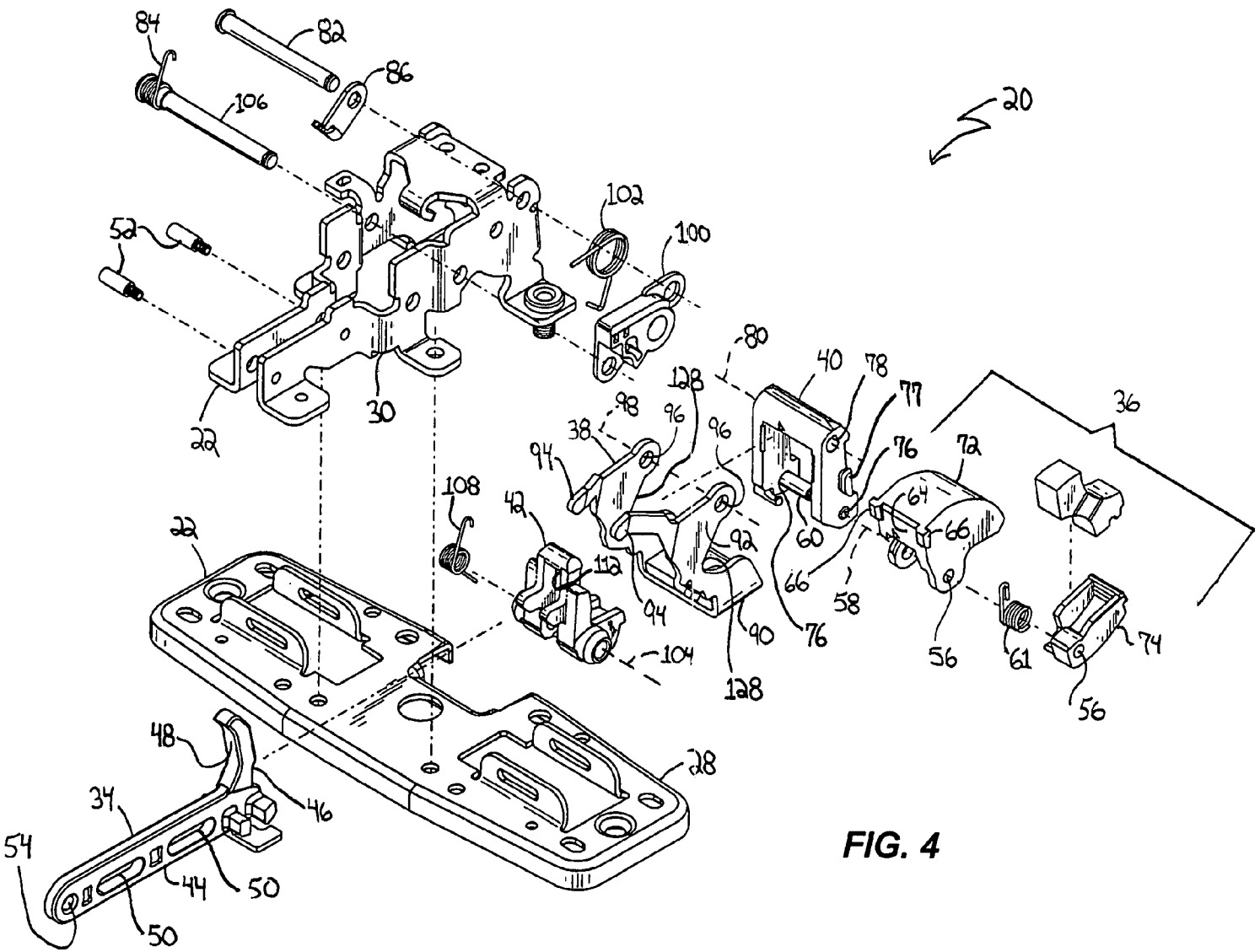
FIG. 4 is an exploded view of the portion of the lock assembly of FIG. 3.

Referring to FIGS. 2, 3 and 4, the lock assembly 20 includes a frame 22, a locking mechanism 24, and an actuator 26. In the embodiment shown the actuator 26 is a push-bar. The illustrated frame 22 includes a base plate 28, a housing 30, and a cover 32. The base plate 28 is coupled and fixed with respect to the door 12, and the housing 30 is coupled and fixed with respect to the base plate 28. The cover 32 is placed over the housing 30 to generally enclose the housing 30 and the locking mechanism 24. In one construction, the base plate 28, the housing 30, and the cover 32 are coupled using fasteners, such as bolts, screws, and the like, and in other constructions the base, the housing, and the cover can be coupled using any suitable connection.

Referring to FIGS. 3 and 4, the locking mechanism 24 includes a control member 34, a latchbolt 36, an auxiliary latchbolt 38, a bridge 40, and a locking member 42. The control member 34 includes a body 44 and a control arm 46 that extends from the body 44 and has a cam surface 48. Two elongated apertures 50 extend through the body 44 and receive pins 52 or shafts that movably couple the control member 34 to the housing 30. A third aperture 54 extends through the control member 34 to couple the control member 34 to the actuator 26 of FIGS. 1 and 2. While the illustrated control member 34 is slidably coupled to the base plate 28 and housing 30, in other constructions the control member can be rotatably coupled to the base plate, the housing, or any combination thereof. In yet other constructions, the control member can be coupled to any suitable member of the lock assembly.

The latchbolt 36 includes an aperture 56 that extends through the latchbolt 36 to define a latchbolt axis 58. The latchbolt aperture 56 receives a pin 60 such that the latchbolt 36 can rotate with respect to the housing 30 and the bridge 40 about the latchbolt axis 58.

Figure 5A:
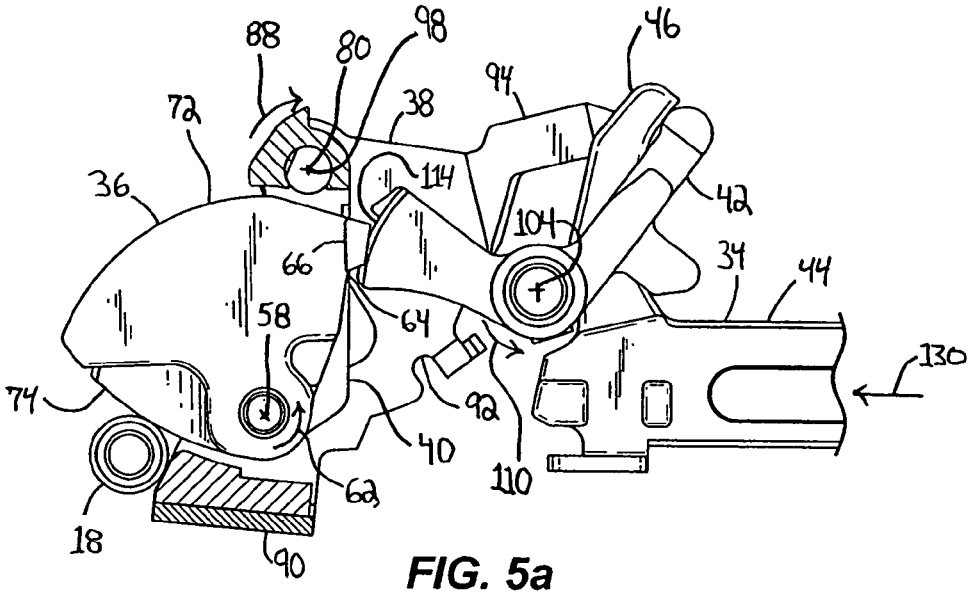
FIGS. 5*a*-5*f* are section views of the lock assembly taken along line 5*a*-5*a* of FIG. 3 with portions of the lock assembly removed for clarity to illustrate the operation of the lock assembly.

Referring to FIGS. 4 and 5*a*, a biasing member 61 is disposed around the latchbolt pin 60. The biasing member 61 is coupled to the latchbolt 36 and the bridge 40 such that the latchbolt 36 is biased about the latchbolt axis 58 in a counterclockwise direction as indicated by an arrow 62 in FIG. 5*a*. While the illustrated latchbolt biasing member 61 is a torsion spring, in other constructions the latchbolt biasing member can include other suitable biasing members such as coil springs, other resilient members, and the like.

With continued reference to FIGS. 4 and 5 the illustrated latchbolt 36 further includes a locking surface 64 having bridge engagement members 66 that extend from the locking surface 64. While the illustrated latchbolt 36 includes two bridge engagement members 66, in other constructions the latchbolt may have more or less than two bridge engagement members that can extend from or be coupled to any suitable location of the latchbolt.

The illustrated latchbolt 36 is a two-piece latchbolt and includes a first latchbolt member 72 and a second latchbolt member 74 as described in U.S. patent application Ser. No. 11/298,334 filed Apr. 5, 2006 the entire contents of which are hereby incorporated by reference. In other constructions, the latchbolt can be any suitable latchbolt, such as a one-piece latchbolt.

Referring to FIGS. 3, 4 and 5*a*, the bridge 40 includes a first aperture 76, a second aperture 78, and auxiliary latchbolt engagement members 77. While in FIG. 4 just one auxiliary latchbolt engagement member 77 is visible, the opposite side of the bridge 40, not visible in FIG. 4, also includes the auxiliary latchbolt engagement member 77. Furthermore, while the illustrated bridge 40 includes two auxiliary latchbolt engagement members 77, in other constructions the bridge can include one, or more than two auxiliary latchbolt engagement members located at any suitable position on the bridge.

The second frame aperture 78 defines a bridge axis 80. A pin 82 extends through the second bridge aperture 78 and the housing 30 such that the bridge 40 can rotate about the bridge axis 80. A bridge biasing member 84 is interconnected with the bridge 40 using a link 86 to bias the bridge 40 about the bridge axis 80 in a clockwise direction as indicated by an arrow 88 in FIG. 5*a*. The bridge 40 is biased into contact with the housing 30 such that the bridge 40 is prevented from rotating further in the clockwise direction as illustrated in FIGS. 3 and 5*a*.

Referring to FIGS. 4 and 5*a*, the first bridge aperture 76 receives the latchbolt pin 60 such that the latchbolt 36 can rotate with respect to the bridge 40 about the latchbolt axis 58. The bridge engagement members 66 of the latchbolt 36 contact the bridge 40 to prevent rotation of the latchbolt 36 through the bridge 40 about the latchbolt axis 58 further in the counterclockwise direction as indicated by the arrow 62 in FIG. 5*a*.

With continued reference to FIGS. 4 and 5*a*, the illustrated auxiliary latchbolt 38 is a generally U-shaped member that includes a bolt portion 90, a body portion 92, and arms 94 that extend from the body portion 92. Auxiliary latchbolt apertures 96 extend through the body portion 92 to define an auxiliary latchbolt axis 98. The illustrated auxiliary latchbolt apertures 96 receive the bridge pin 82 such that the auxiliary latchbolt 38 rotates with respect to the housing 30 about the auxiliary latchbolt axis 98 that is co-axial with the bridge axis 80. A biasing member support bracket 100 is coupled to the housing 30 and receives a latchbolt biasing member 102 that biases the auxiliary latchbolt 38 in the clockwise direction about the auxiliary latchbolt axis 98 as indicated by the arrow 88 in FIG. 5*a*.

The locking member 42 includes an aperture that defines a locking member axis 104. A locking member pin 106 is received by the locking member aperture and housing 30 such that the locking member 42 rotates with respect to the housing 30 about the locking member axis 104. A biasing member 108 is disposed around the locking member pin 106. The biasing member 108 biases the locking member 42 into an engaged position, as illustrated in FIG. 5*a*, or in a counterclockwise direction about the locking member axis 104 as illustrated by an arrow 110 in FIG. 5*a*.

Referring to FIGS. 3 and 4, the illustrated locking member 42 further includes a control member receiving aperture 112 that receives the control arm 46 of the control member 34. While the illustrated locking member 42 is coupled to the control member 34 using the control member receiving aperture 112, in other constructions the locking member can be coupled to the control member using any suitable connection.

Figure 5B:
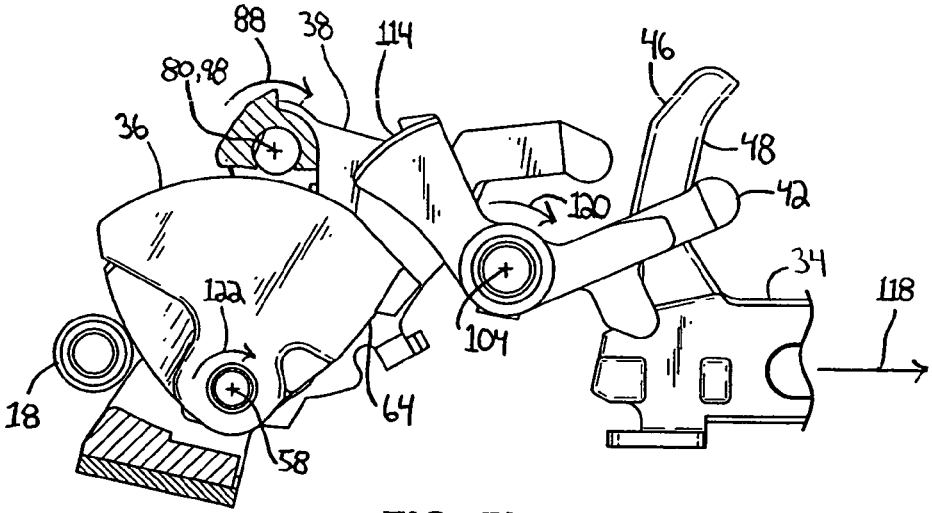

Referring to FIG. 5*b*, the locking member 42 includes a cam surface 114 that is formed on one end of the locking member 42. The illustrated cam surface 114 is generally curved and is configured to engage the locking surface 64 of the latchbolt 36.

Referring to FIGS. 2 and 3, although not illustrated, the actuator 26 is coupled to the control member 34 using the aperture 54. The illustrated actuator 26 includes the push-bar 116 that can be depressed to produce a corresponding movement of the control member 34. While the illustrated actuator 26 includes the push-bar 116, in other constructions the actuator may take other forms such as a rotatable handle or other shapes and styles of push-bars. Furthermore, as would be understood by one of ordinary skill in the art, the lock assembly 20 may include a second actuator located on the exterior surface of the door 12. The second actuator can include a rotatable handle, thumb-piece trim device, and the like that is coupled to the control member 34 and actuates the control member 34 similar to the push-bar 116.

Figure 6:
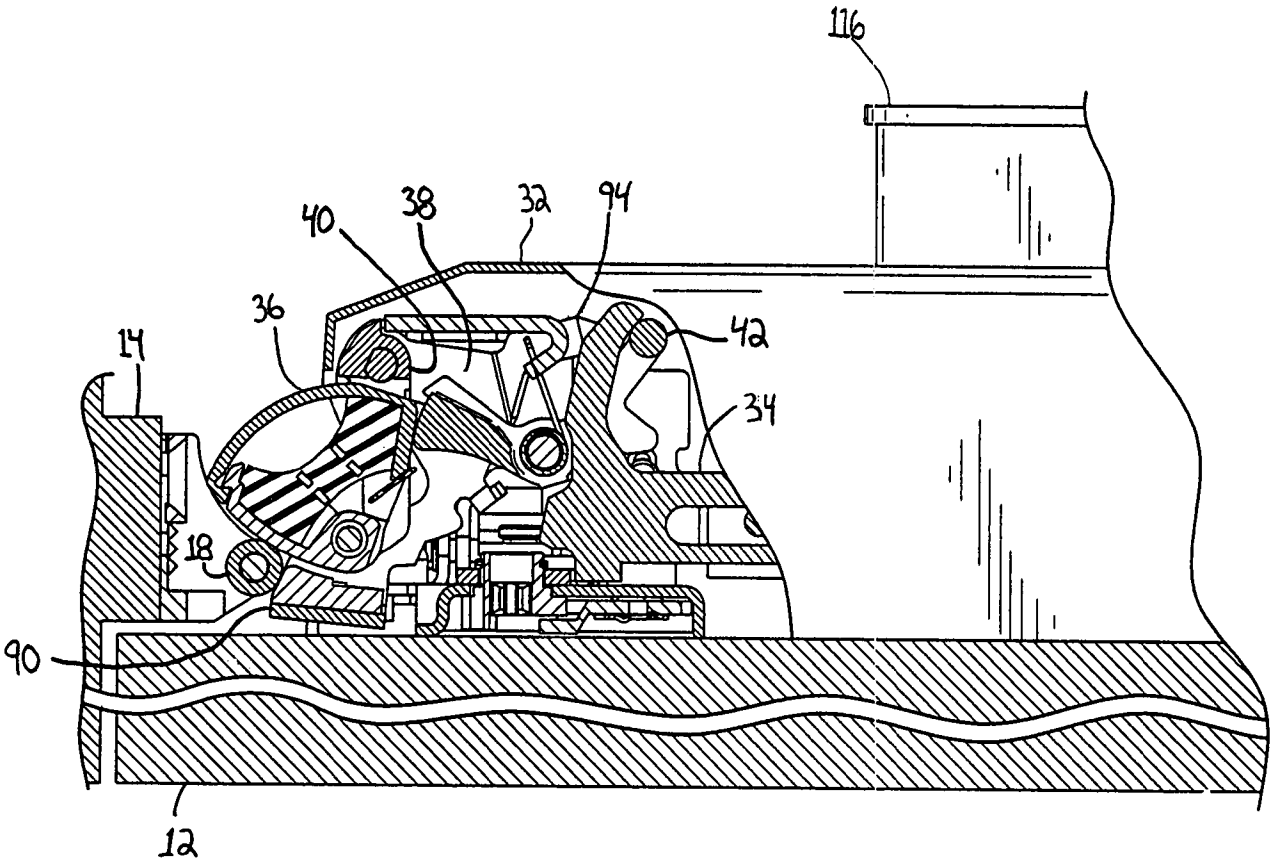
FIG. 6 is a section view of the door and lock assemblies taken along line 6-6 of FIG. 2 showing the door in the closed position.

Referring to FIGS. 2, 5*a*, and 6 in operation, if the door 12 is in the closed position and the control member 34 is in a locked position, the locking member 42 is in the engaged position and the latchbolt 36 engages the strike 18 to prevent the door 12 from rotating to the open position. In the illustrated construction, when the door 12 is in the closed position the auxiliary latchbolt 38, which is biased in the clockwise direction about the auxiliary latchbolt axis 98, is biased in to contact with the strike 18 such that the bolt portion 90 of the auxiliary latchbolt 38 contacts the strike 18. The strike 18 contacts the auxiliary latchbolt 38 to prevent further rotation of the auxiliary latchbolt 38 in the clockwise direction about the auxiliary latchbolt axis 98. Therefore, in the illustrated construction, when the door 12 is in the closed position, the strike 18 contacts the auxiliary latchbolt 38 to prevent the arms 94 of the auxiliary latchbolt 38 from contacting, or biasing, the locking member 42.

Figure 5C:
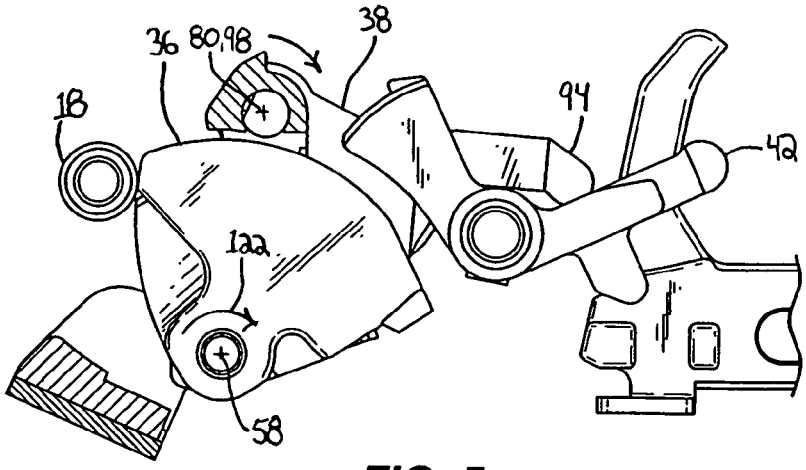
Figure 7:
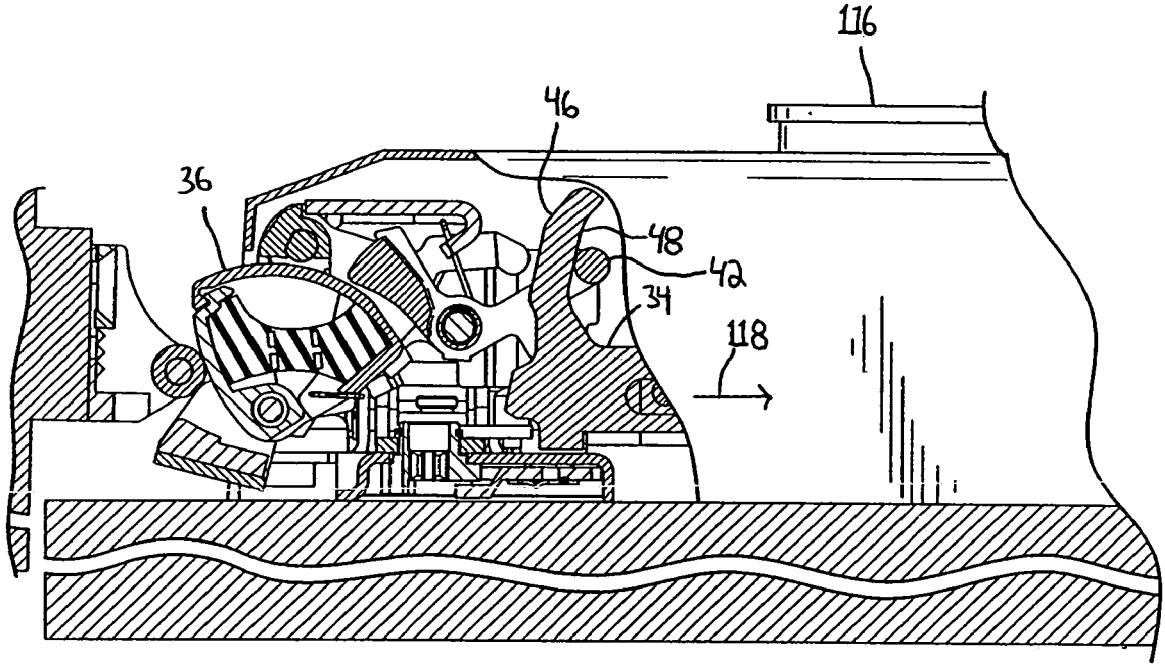
FIG. 7 is a section view of the door and lock assemblies taken along line 7-7 of FIG. 2 showing the door between the closed position and an open position.

Referring to FIGS. 5*b* and 7, if the push-bar 116 is depressed the control member 34 moves to the right as illustrated by an arrow 118 in FIGS. 5*b* and 7. As the control member 34 moves right, the cam surface 48 of the control arm 46 forces the locking member 42 to rotate about the locking member axis 104 in a clockwise direction as indicated by an arrow 120 in FIG. 5*b*. Therefore, the locking member 42 moves to a disengaged position, allowing the latchbolt 36 to rotate in a clockwise direction about the latchbolt axis 58 (indicated by an arrow 122 in FIG. 5*b*) to allow the user to rotate the door 12 toward the open position. As the user opens the door 12, the strike 18 forces the latchbolt 36 into a retracted position as illustrated in FIGS. 5*b*, 5*c*, and 7. While the illustrated latchbolt 36 rotates in the clockwise direction as the door 12 moves toward the open position, in other constructions the latchbolt can be arranged to translate, rather than rotate, as the door moves toward the open position.

Referring to FIGS. 5*b* and 5*c*, as the door 12 continues to rotate to the open position, the auxiliary latchbolt 38, which is biased in the clockwise direction as indicated by the arrow 88, rotates about the auxiliary latchbolt axis 98. As the auxiliary latchbolt 38 rotates about its axis 98, the latchbolt arms 94 contact the locking member 42 as illustrated in FIG. 5*c*.

Figure 5D:
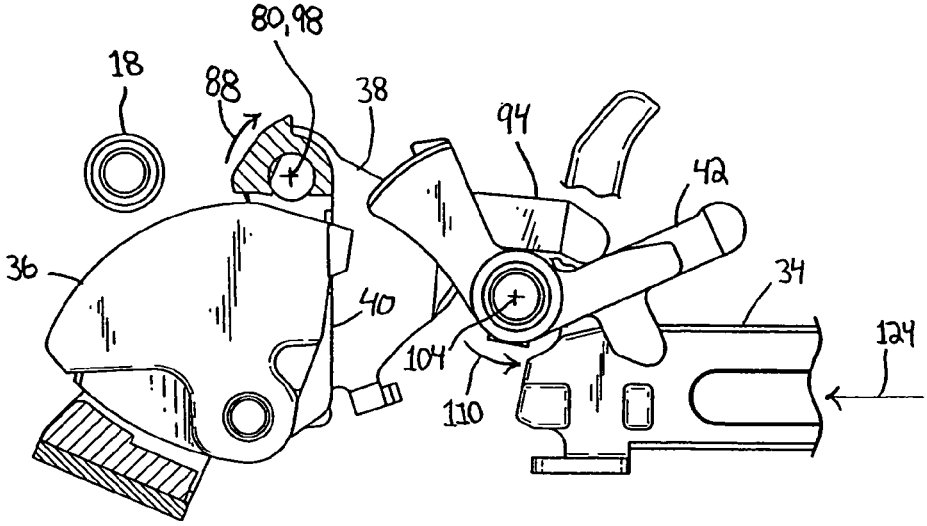

Referring to FIGS. 1 and 5*d*, typically after the user opens the door 12 and exits through the door frame 14, the user releases the push-bar 116. The push-bar 116, which is biased into the extended position, moves from the depressed position to the extended position after being released. When the push-bar 116 moves to the extended position, the control member 34, which is biased to the left, moves left, out of engagement with the locking member 42, and back to the locked position as indicated by the arrow 124 in FIG. 5*d*. Therefore, the control member 34 does not prevent the locking member 42 from rotating counterclockwise (indicated by the arrow 110 in FIG. 5*d*) about the locking member axis 104 and into the engaged position. However, the auxiliary latchbolt arms 94 of the auxiliary latchbolt 38 contact the locking member 42 to prevent the locking member 42 from rotating into the engaged position.

Figure 5E:
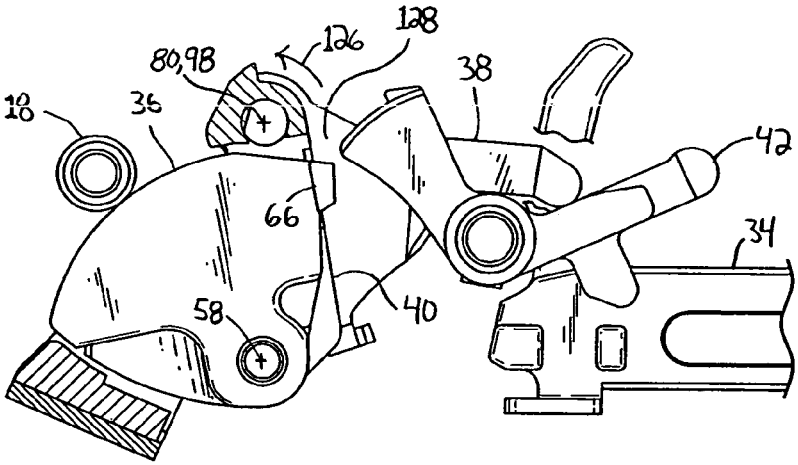

Referring to FIGS. 5*d* and 5*e*, the latchbolt 36 is biased counterclockwise about the latchbolt axis 58 by the latchbolt biasing member 61 (shown in FIG. 4), and therefore the bridge engagement members 66 of the latchbolt 36 are in contact with the bridge 40 when the door 12 is in the open position. Then, as the door 12 rotates from the open position back to the closed position, the latchbolt 36 contacts the strike 18 and because the bridge engagement members 66 contact the bridge 40, the latchbolt 36 and the bridge 40 together rotate about the bridge axis 80 in the counterclockwise direction as illustrated by an arrow 126 in FIG. 5*e*. Meanwhile, the auxiliary latchbolt 38 continues to contact the locking member 42 to prevent the locking member 42 from rotating into the engaged position. At this point, if the locking member 42 was allowed to rotate into the engaged position, the latchbolt 36 and the bridge 40 would be unable to rotate about the bridge axis 80 and thus the door 12 would be unable to move into the closed position. While the illustrated latchbolt 36 rotates in the counterclockwise direction as the door 12 moves from the open position toward the closed position, in other constructions the latchbolt can be arranged to translate, rather than rotate, as the door moves toward the closed position.

Figure 5F:
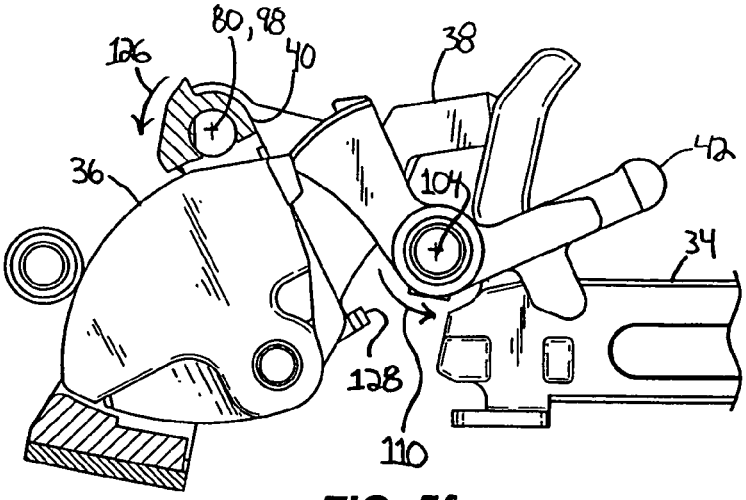

Referring to FIGS. 4 and 5*f*, as the door continues to rotate toward the closed position, the latchbolt 36 and the bridge 40 continue to rotate about the bridge axis 80 until the auxiliary latchbolt engagement members 77 of the bridge 40 engage surfaces 128 of the auxiliary latchbolt 38 causing the auxiliary latchbolt 38 to rotate counterclockwise about the auxiliary latchbolt axis 98 as indicated by the arrow 126 in FIG. 5*e*. As the auxiliary latchbolt 38 rotates counterclockwise it no longer contacts the locking member 42 and the locking member 42, which is biased in the counterclockwise direction about the axis 104 as indicated by the arrow 110, rotates toward the engaged position.

Referring to FIGS. 5*a* and 6, when the door 12 returns to the closed position, the latchbolt 36 and bridge 40 rotate clockwise about the bridge axis 80 such that the latchbolt returns to the extended position, and the locking member 42 rotates into the engaged position.

With continued reference to FIGS. 5*a* and 6, the locking member 42 prevents rotation of the latchbolt 36 about both the latchbolt axis 58 and the bridge axis 80 when the locking member 42 is in the engaged position and the control member 34 is in the locked position as illustrated in FIGS. 5*a* and 6. For example, applying a force to the door 12 in a direction that tends to open the door 12 (i.e., pulling on an exterior door handle), forces the latchbolt 36 into contact with the cam surface 114 of the locking member 42. The cam surface 114 of the locking member 42 engages the latchbolt 36 such that the locking member 42 is forced to rotate counterclockwise about the locking member axis 104. As illustrated in FIG. 5*a*, rotation of the locking member 42 in the counterclockwise direction is prevented when the locking member 42 contacts the control arm 46 of the control member 34 which is prevented from moving further left as indicated by the arrow 130. Therefore, the latchbolt 36 is locked, unable to rotate clockwise about the latchbolt axis 58, which prevents the door 12 from being opened unless the control member 34 is moved to the unlocked position.

Referring to FIG. 5*a*, in addition, the cam surface 114 of the locking member 42 engages the latchbolt 36 to prevent rotation of the latchbolt 36 and the bridge 40 about the bridge axis 80. Applying a force to the latchbolt 36 that tends to rotate the latchbolt 36 and the bridge 40 in the counterclockwise direction about the bridge axis 80 forces the latchbolt 36 into contact with the cam surface 114. The cam surface 114 of the locking member 42 engages the latchbolt 36 such that the locking member 42 is generally prevented from rotating in either the clockwise or counterclockwise direction about the locking member axis 104. An example of such a force may include an unauthorized user pushing directly on the latchbolt 36 with their finger or some other device when the door 12 is in the closed position.

Various features and advantages of the invention are set forth in the following claims.

What is claimed is:

1. A lock assembly configured for use with a door movably coupled to a door frame having a strike, the door movable between an open position and a closed position, the lock assembly comprising:

a housing coupled to the door;

a control member movably coupled to the housing from a locked position to an unlocked position to allow for movement of the door with respect to the door frame;

a component movably coupled to the housing;

a latchbolt coupled to the component and movable relative to the housing along a first path when the door moves from the closed position to the open position and the latchbolt engages the strike, and movable relative to the housing along a second path when the door moves from the open position to the closed position and the latchbolt engages the strike, the first path different than the second path;

a locking member coupled to the control member such that the control member moves the locking member relative to the housing into and out of an engaged position with the latchbolt, the locking member including a surface that contacts the latchbolt when the locking member is in the engaged position to prevent movement of the latchbolt along the first path and along the second path; and an actuator coupled to the control member to move the control member from the locked position to the unlocked position.

2. The lock assembly of claim 1, wherein the locking member includes a biasing member configured to bias the locking member toward the engaged position, and further comprising an auxiliary latchbolt that contacts the locking member to bias the locking member out of the engaged position when the door is in the open position.

3. The lock assembly of claim 2, wherein the auxiliary latchbolt contacts the strike when the door is in the closed position to generally prevent the auxiliary latchbolt from biasing the locking member out of the engaged position.

4. The lock assembly of claim 2, further comprising an auxiliary latchbolt biasing member configured to bias the auxiliary latchbolt into contact with the locking member.

5. The lock assembly of claim 2, wherein the auxiliary latchbolt is rotatably coupled to the housing.

6. The lock assembly of claim 1, wherein the component is a bridge member that interconnects the latchbolt to the housing.

7. The lock assembly of claim 6, wherein the bridge member is rotatably coupled to the housing about a bridge axis, and wherein the bridge member rotates relative to the housing as the latchbolt moves along the first path.

8. The lock assembly of claim 6, wherein the latchbolt is rotatably coupled to the bridge member about a latchbolt axis, and wherein the latchbolt rotates relative to the bridge member as the latchbolt moves along the second path.

9. The lock assembly of claim 8, wherein the latchbolt includes a bridge engagement member configured to engage the bridge member such that the latchbolt and the bridge member rotate together relative to the housing about the bridge axis.

10. The lock assembly of claim 1, wherein the actuator includes a push-bar movable from an extended position to a depressed position;

wherein when the push-bar is in the extended position the locking mechanism is in the locked position and when the push-bar in is in the depressed position the locking member is in the unlocked position; and wherein the push-bar is biased into the extended position.

11. The lock assembly of claim 1, wherein the surface of the locking member that contacts the latchbolt when the locking member is in the engaged position is a cam surface.

12. A door assembly comprising:

a door frame;

a strike coupled to the door frame;

a door movably coupled to the door frame, the door movable between an open position and a closed position; and a lock assembly including, a housing;

a component movably coupled to the housing;

a latchbolt coupled to the component and including a first surface and a second surface, the latchbolt movable relative to the housing and the component along a first path as the strike contacts the first surface of the latchbolt and the door moves from the closed position toward the open position, the latchbolt and the component movable relative to the housing along a second path as the strike contacts the second surface of the latchbolt and the door moves from the open position toward the closed postion, the first path different than the second path;

a locking member including a locking member surface, wherein the locking member surface contacts the latchbolt to prevent movement of the latchbolt along the first path and the second path when the door is in the closed position; and an actuator coupled to the locking member to move the locking member from the engaged position to a disengaged position when the door is in the closed position.

13. The door assembly of claim 12, wherein the locking member includes a biasing member configured to bias the locking member into an engaged position such that the locking member surface contacts the latchbolt, and wherein the lock assembly further includes an auxiliary latchbolt that contacts the locking member to bias the locking member out of the engaged position when the door is in the open position.

14. The door assembly of claim 13, wherein the lock assembly further includes an auxiliary latchbolt biasing member configured to bias the auxiliary latchbolt into contact with the locking member and the strike.

15. The door assembly of claim 13, wherein the auxiliary latchbolt contacts the strike when the door is in the closed position to generally prevent the auxiliary latchbolt from biasing the locking member out of the engaged position.

16. The door assembly of claim 13, wherein the auxiliary latchbolt is rotatably coupled to the housing about an auxiliary latchbolt axis.

17. The door assembly of claim 12, wherein the component is a bridge member that interconnects the latchbolt and the housing, and wherein the bridge member is rotatably coupled to the housing about a bridge axis to move along the second path.

18. The door assembly of claim 17, wherein the latchbolt is rotatably coupled to the bridge member about a latchbolt axis to move along the first path.

19. The door assembly of claim 18, wherein the latchbolt includes a bridge engagement member configured to engage the bridge member such that the latchbolt and the bridge member rotate together about the bridge axis during movement along the second path.

20. The door assembly of claim 12, wherein the actuator includes a push-bar movable from an extended position to a depressed position to move the locking member.

21. The door assembly of claim 12, wherein the locking member surface of the locking member is a cam surface.

22. A lock assembly configured for use with a door movably coupled to a door frame having a strike, the door movable between a closed position and an open position, the lock assembly comprising:

a housing coupled to the door;

a control member movably coupled to the housing from a locked position to an unlocked position to allow for rotation of the door with respect to the door frame;

a bridge member rotatably coupled to the housing about a first axis;

a latchbolt rotatably coupled to the bridge member about a second axis, the latchbolt rotatable with the bridge member relative to the housing about the first axis when the latchbolt engages the strike as the door closes, and rotatable relative to the bridge member about the second axis when the latchbolt engages the strike as the door opens, the first axis spaced apart from and different than the second axis;

a locking member coupled to the control member such that the control member moves the locking member relative to the housing into and out of an engaged position to generally prevent rotation of the latchbolt about at least one of the first and second axes;

an auxiliary latchbolt configured to bias the locking member out of the engaged position when the door is in the open position; and an actuator coupled to the control member to move the control member from the locked position to the unlocked position.

23. The lock assembly of claim 22, wherein the auxiliary latchbolt is rotatably coupled to the housing.

24. The lock assembly of claim 22, wherein the auxiliary latchbolt contacts the strike when the door is in the closed position.

25. The lock assembly of claim 24, wherein the auxiliary latchbolt includes a biasing member configured to bias the auxiliary latchbolt into contact with the strike when the door is in the closed position.

26. The lock assembly of claim 22, wherein the auxiliary latchbolt is generally spaced apart from the locking member when the door is in the closed position.

27. The lock assembly of claim 22, wherein the locking member includes a surface that contacts the latchbolt when the locking member is in the engaged position and the door is in the closed position to prevent movement of the latchbolt in the first direction and the second direction.

28. A lock assembly configured for use with a door rotatably coupled to a door frame having a strike, the lock assembly comprising:

a housing coupled to the door;

a control member movably coupled to the housing from a locked position to an unlocked position to allow for rotation of the door with respect to the door frame;

a component rotatably coupled to the housing about a first axis;

a latchbolt rotatably coupled to the component about a second axis, the latchbolt rotatable with the component relative to the housing about the first axis when the latchbolt engages the strike as the door closes, and rotatable relative to the component about the second axis when the latchbolt engages the strike as the door opens, the first axis different than the second axis;

a locking member coupled to the control member such that the control member moves the locking member relative to the housing into and out of an engaged position with the latchbolt, the locking member including a surface that contacts the latchbolt when the locking member is in the engaged position to prevent rotation of the latchbolt about the first axis and the second axis; and an actuator coupled to the control member to move the control member from the locked position to the unlocked position.

29. The lock assembly of claim 28, wherein the locking member includes a biasing member configured to bias the locking member toward the engaged position, and further comprising an auxiliary latchbolt that contacts the locking member to bias the locking member out of the engaged position.

30. The lock assembly of claim 29, wherein the door is rotatable between a closed position and an open position, and wherein the auxiliary latchbolt contacts the strike when the door is in the closed position to generally prevent the auxiliary latchbolt from biasing the locking member out of the engaged position.

31. The lock assembly of claim 30, wherein the auxiliary latchbolt contacts the locking member when the door is in the open position.

32. The lock assembly of claim 29, further comprising an auxiliary latchbolt biasing member configured to bias the auxiliary latchbolt into contact with the locking member.

33. The lock assembly of claim 29, wherein the auxiliary latchbolt is rotatable with respect to the housing about the first axis.

34. The lock assembly of claim 28, wherein the component is a bridge member that interconnects the latchbolt to the housing.

35. The lock assembly of claim 34, wherein the latchbolt includes a bridge engagement member configured to engage the bridge member such that the latchbolt and the bridge member rotate together about the second axis.

36. The lock assembly of claim 28, wherein the actuator includes a push-bar movable from an extended position to a depressed position;

wherein when the push-bar is in the extended position the locking mechanism is in the locked position and when the push-bar in is in the depressed position the locking member is in the unlocked position; and wherein the push-bar is biased into the extended position.

* * * * *

UNITED STATES PATENT AND TRADEMARK OFFICE

CERTIFICATE OF CORRECTION

PATENT NO. : 7,832,777 B2
APPLICATION NO. : 11/398574
DATED : November 16, 2010
INVENTOR(S) : Russell A. Banks and Bradley W. Trent It is certified that error appears in the above-identified patent and that said Letters Patent is hereby corrected as shown below:

Column 4, Line 24, delete "11/298,334" and insert --11/398,334--

Signed and Sealed this
Fifteenth Day of March, 2011

David J. Kappos

David J. Kappos
*Director of the United States Patent and Trademark Office*